United States Patent [19]

Shannon et al.

[11] 3,980,414

[45] Sept. 14, 1976

[54] CORE AND PRESSING HEAD OF MOLD BOX ASSEMBLY

[75] Inventors: Richard F. Shannon, Lancaster, Ohio; Paul H. Scheuerle, Dallas, Tex.

[73] Assignee: Owens-Corning Fiberglas Corporation, Toledo, Ohio

[22] Filed: Sept. 29, 1975

[21] Appl. No.: 617,351

[52] U.S. Cl. ..... 425/85; 425/394; 425/352; 425/412; 425/405 R; 425/423

[51] Int. Cl.[2] ..... B30B 9/28

[58] Field of Search ..... 425/85, 86, 112, 117, 425/127, 128, 384, 385, 387, 388, 394, 401, 398, 405 R, 412, 415, 416, 420, 423, DIG. 19, DIG. 60, 352, 354, 355

[56] References Cited

UNITED STATES PATENTS

| | | | |
|---|---|---|---|
| 2,979,770 | 4/1961 | Greene et al. | 425/416 X |
| 3,128,503 | 4/1964 | Hahn et al. | 425/394 |
| 3,158,547 | 11/1964 | Smith | 425/352 X |
| 3,162,895 | 12/1964 | Pusch | 425/394 |
| 3,179,726 | 4/1965 | Perry | 425/388 X |
| 3,295,167 | 1/1967 | Corbin | 425/394 |
| 3,748,072 | 7/1973 | Whelan | 425/412 X |

*Primary Examiner*—J. Howard Flint, Jr.
*Attorney, Agent, or Firm*—John W. Overman; Paul J. Rose

[57] ABSTRACT

A greater percentage of hole area is provided in opposite leg portions of the semi-cylindrical perforated backing plate of either the core or the pressing head of a mold box assembly, used in the pressing of a slurry into semi-cylindrical bodies of lightweight thermal insulation for pipe, than in the crown portion connecting the leg portions. More uniform density is thereby provided in the pieces of insulation, and breakage during handling before curing is greatly reduced.

3 Claims, 6 Drawing Figures

CORE AND PRESSING HEAD OF MOLD BOX ASSEMBLY

This invention relates to mold box assemblies used in the pressing of a slurry into semi-cylindrical bodies of lightweight thermal insulation for pipe, and more particularly to an improvement either in the core or in the pressing head of the mold box assembly.

The backing plates of the cores and pressing heads of former mold box assemblies were provided throughout with holes of uniform size and spacing. Considerable variation in density resulted in pieces of pipe insulation formed by the prior mold box assemblies, and slip planes were evident. Opposed leg portions of the semi-cylindrical pieces of pipe insulation were thus weak and frequently broke during handling before curing.

In accordance with the invention, a greater percentage of hole area is provided in opposed leg portions of the semi-cylindrical perforated backing plate either of the core or of the pressing head of a mold box assembly than in the crown portion. Pieces of pipe insulation formed in the mold box assembly with either the improved core or the improved pressing head have more uniform density than those formed in prior mold box assemblies, and slip planes in the insulation are virtually eliminated. Handling of the improved pieces of pipe insulation subsequently to forming but before curing results in much less breakage.

An object of the invention is to provide either an improved core or an improved pressing head, or both, in a mold box assembly used in the pressing of a slurry into semi-cylindrical pieces of pipe insulation.

Figure 2:
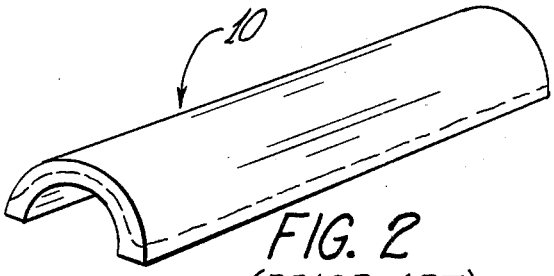
FIG. 2 (PRIOR ART)
FIG. 2 is a perspective view of a piece of pipe insulation formed by a prior mold box assembly.

With reference to the drawings, FIG. 2 shows a piece of pipe insulation 10 made by a prior mold box assembly having holes of the same size uniformly spaced throughout the backing plates of both the core and the pressing head. The insulation 10 is pressed from a slurry of quicklime, diatomaceous earth, and fibrous reinforcing material. As the pressing head of such a mold box assembly is moved downwardly into a charge of slurry in the mold box, the solids in the slurry move upwardly along the semi-cylindrical surface of the pressing head and downwardly along the semi-cylindrical surface of the core. As a result, a slip plane indicated by the broken line in FIG. 2 occurs in the piece of pipe insulation 10. Such a slip plane can cause the piece of pipe insulation 10 to separate into two pieces.

Further, because the crown area is compressed at a faster rate due to the geometry of the piece, the density of the cured insulation in the vicinity of the crown is about fifteen pounds per cubic foot (225 kilograms per cubic meter), while that in the opposite leg portions is about eleven pounds per cubic foot (165 kilograms per cubic meter). The slip plane and the lack of uniform density renders the piece of pipe insulation 10 easily breakable in handling prior to curing. The curing process includes chemical reaction of the quicklime and diatomaceous earth in an enclosure containing steam under pressure and preferably also drying in an oven at atmospheric pressure to form a hydrous calcium silicate gel with fibrous reinforcing material.

Figure 1:
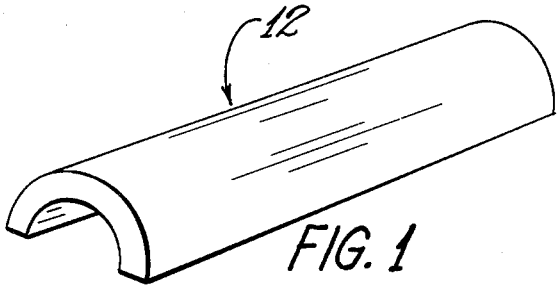
FIG. 1 is a perspective view of a piece of pipe insulation formed by the improved mold box assembly of the invention.

FIG. 1 shows a piece of pipe insulation 12 made by a mold box assembly having an improved core constructed in accordance with the invention. Because of the improved core, as the pressing head of the mold box assembly is moved downwardly into a charge of the slurry in the mold box, the water squeezed out from the slurry escapes more rapidly from the leg portions of the piece of pipe insulation 12 being formed without the layered movement of the solids present in the operation of prior mold box assemblies. The tendency of the material to develop slip planes is greatly reduced, and further, the density of the cured piece of pipe insulation 12 is more nearly uniform. For example, the density of the insulation in the vicinity of the crown may be about 13.7 pounds per cubic foot (205 kilograms per cubic meter), while that in the opposite leg portions may be about 12.5 pounds per cubic foot (187 kilograms per cubic meter). The absence of slip planes and the more nearly uniform density renders the piece of pipe insulation 12 less breakable in handling before curing. Efficiency in the manufacturing of whole, unbroken, semi-cylindrical pieces of pipe insulation has been increased by as much as thirty percent for some sizes.

Figure 3:
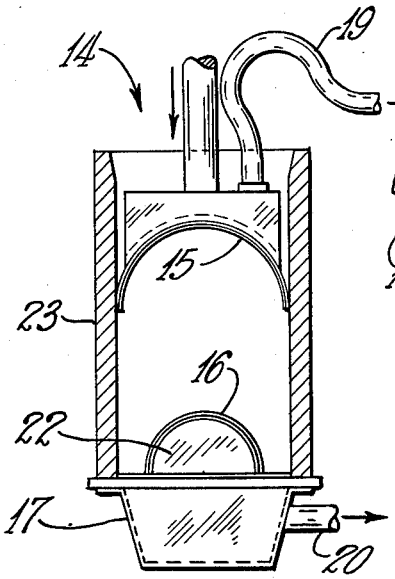
FIG. 3 is a front elevational view of the mold box assembly of the invention and associated portions of a press, a pressing head of the mold box assembly being in an intermediate position.

FIG. 3 shows a mold box assembly 14 including a vertically reciprocable pressing head 15 in an intermediate position, a stationary core 16 over a suction box 17 of a press, and a mold box 23. Suction lines 19 and 20 are provided respectively for the pressing head 15 and suction box 17.

Figure 4:
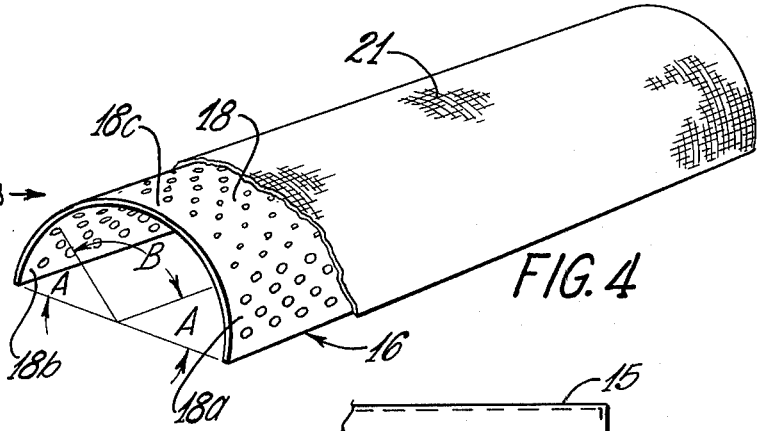
FIG. 4 is a perspective view of the core of the mold box assembly of FIG. 3, with a portion of the screen cloth broken away and the supporting frame and end closure plates omitted.
Figure 5:
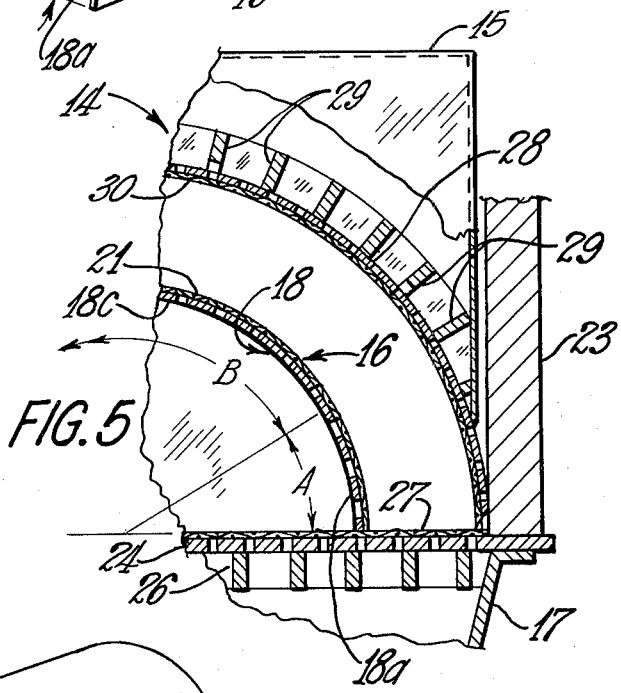
FIG. 5 is an enlarged fragmentary vertical sectional view of the mold box assembly of FIG. 3, the pressing head being in a fully lowered position.

The core 16 is shown in detail in FIG. 4, a screen cloth 21 thereof being partially broken away and supporting framework and end closure plates being omitted. End closure plates 22 of the core 16 are shown in FIGS. 3 and 5. The core 16 also includes a semi-cylindrical perforated metal backing plate 18, opposite leg portions **18*a* and 18*b* thereof being defined by an angle A and a crown portion 18*c* thereof connecting the leg portions 18*a* and 18*b* being defined by an angle B. The leg portions 18*a* and 18*b* and the crown portion 18*c* are each provided with a plurality of rows of holes, the holes in one row being staggered from those in adjacent rows. In accordance with the invention, the holes in the leg portions 18*a* and 18*b* are made larger than the holes in the crown portion 18*c*, the number of holes per unit area being the same. A greater percentage of hole area is thus provided in the leg portions 18*a* and 18*b* than in the crown portion 18*c***.

In practice, satisfactory results have been obtained using 30° for angle A and 120° for angle B. For ease of illustration, the drawings are somewhat schematic. On a backing plate 18 having a nominal radius of 10 inches (0.254 meters), each of the leg portions **18*a* and 18*b* is provided with 12 rows of holes on staggered one-half inch (1.27 cm.) centers and the crown portion 18*c* is provided with 48 rows of similarly spaced holes, the holes in the leg portions 18***a* and 18*b* being three-eighths inch (0.9525 cm.) in diameter and the holes in the crown portion 18*c* being five-sixteenths inch (0.7937 cm.) in diameter. The number of holes per square inch in both the crown portion and the leg portions is five, and the percentage of hole area or open area in the crown portion 18*c* is thirty-five percent while that of the leg portions 18*a* and 18*b* is 52 percent. The greater percentage of hole area in the leg portions results in improved pieces of pipe insulation 12 having more uniform density and virtually no evidence of slip planes. Breakage in handling before curing is greatly reduced.

FIG. 5 shows portions of the mold box assembly 14 and the suction box 17 of the press, the pressing head 15 being in its lowermost position. The mold box 23 and the core 16 are supported on a perforated bed plate 24 of the press during a pressing operation, the plate 24 being reinforced with a grid 26 and covered with a screen cloth 27. The pressing head 15 includes a semi-cylindrical perforated backing plate 28 which may have, for example, five-sixteenths inch holes spaced on staggered seven-sixteenths inch centers in both crown and leg portions. This gives six and one-half holes per square inch and a fifty percent hole area. The backing plate 28 is reinforced by a semi-cylindrical grid 29 and covered with a screen cloth 30.

Figure 6:
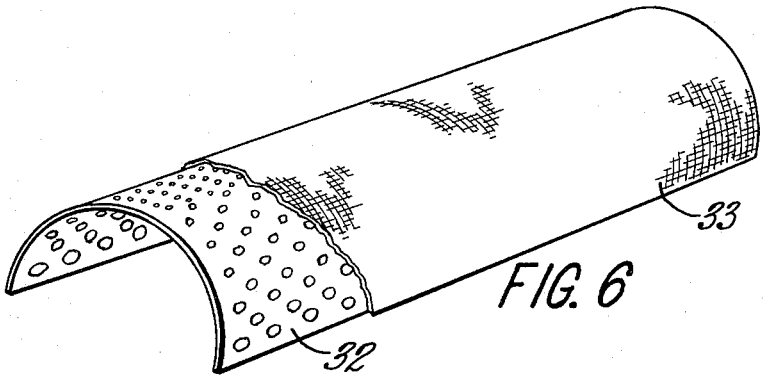
FIG. 6 is a perspective view similar to FIG. 4, but showing an alternative preferred construction of the backing plate of the core.

FIG. 6 shows another embodiment of the invention in which a core backing plate 32 covered with a screen cloth 33 is provided with rows of holes, the holes in each row being the same size but the holes in successive rows increasing from the top of the crown to the bottom of one leg portion and from the top of the crown to the bottom of the other leg portion. For ease of illustration, the backing plate 32 is shown somewhat schematically. As an example of such a backing plate which may be used in actual practice and measuring angles downwardly toward the bottom of each leg from a vertical plane through the longitudinal axis of the semi-cylindrical backing plate, the first fifteen degrees of the backing plate might be provided with holes one-eighth inch (0.3175 cm.) in diameter. From 15° to 30°, the backing plate might be provided with holes three-sixteenths inch (0.4763 cm.) in diameter. From thirty to 45°, the backing plate might be provided with holes one-fourth inch (0.635 cm.) in diameter. From 45° to 60°, the backing plate might be provided with holes three-eighths inch (0.9525 cm.) in diameter. From sixty to 90°, the backing plate might be provided with holes seven-sixteenths inch (1.11 cm.) in diameter. The smaller the holes in each row are, the closer together the rows would be. The percentage of hole area would increase in steps from the top of the crown to the bottom of the leg portions.

While one of the principal advantages of the invention is the great reduction in breakage during handling of insulation before curing, the invention can be used advantageously in the production of pipe insulation from prereacted gel, which needs no curing after pressing. A product of more uniform density results.

It is within the scope of the invention to provide a greater percentage of hole area in opposite leg portions of the backing plate 28 of the pressing head 15 than in the crown portion thereof. The representation in FIG. 4 could just as well be the backing plate 28 rather than the backing plate 18 of the core 16, disregarding the screens 22 and 30.

Various modifications may be made in the structures shown and described without departing from the spirit and scope of the invention.

We claim:

1. In a mold box assembly for use in pressing semi-cylindrical pieces of insulation from a slurry and including a mold box, a core having a semi-cylindrical perforated backing plate, and a reciprocable pressing head having a semi-cylindrical perforated backing plate adapted to be moved into concentric relationship with the backing plate of the core, the improvement comprising a greater percentage of hole area, as a percent of total area, in a pair of opposite leg portions of one of the backing plates than in a crown portion of the respective backing plate connecting the leg portions.

2. A mold box assembly as claimed in claim 1 wherein one of the backing plates has rows of holes extending parallel to the axis thereof and centered equidistantly along the arcuate length thereof, the holes in the crown portion being of one size and the holes in the leg portions being of another larger size.

3. A mold box assembly as claimed in claim 1 wherein one of the backing plates has rows of holes extending parallel to the axis thereof, the holes in each row are of the same size, and the holes in successive groups of rows from the center of the crown portion toward the free end of each of the leg portions increase in size.

* * * * *